US010378134B2

(12) United States Patent
Minamide

(10) Patent No.: US 10,378,134 B2
(45) Date of Patent: Aug. 13, 2019

(54) NONWOVEN FABRIC FOR MOLDING AND SURFACE MATERIAL FOR AUTOMOBILE

(71) Applicant: JAPAN VILENE COMPANY, LTD., Tokyo (JP)

(72) Inventor: Shinsuke Minamide, Shiga (JP)

(73) Assignee: JAPAN VILENE COMPANY, LTD., Tokyo (JP)

( * ) Notice: Subject to any disclaimer, the term of this patent is extended or adjusted under 35 U.S.C. 154(b) by 443 days.

(21) Appl. No.: 15/048,069

(22) Filed: Feb. 19, 2016

(65) Prior Publication Data

US 2016/0244899 A1 Aug. 25, 2016

(30) Foreign Application Priority Data

Feb. 19, 2015 (JP) ..... 2015-030215

(51) Int. Cl.

| | |
|---|---|
| ***D04H 13/00*** | (2006.01) |
| ***D04H 1/488*** | (2012.01) |
| ***D06P 1/44*** | (2006.01) |
| ***D06P 1/52*** | (2006.01) |
| ***D06P 1/54*** | (2006.01) |
| ***D04H 1/64*** | (2012.01) |
| ***D04H 1/66*** | (2012.01) |

(52) U.S. Cl.

CPC ..... *D04H 1/488* (2013.01); *D04H 1/64* (2013.01); *D04H 1/66* (2013.01); *D06P 1/44* (2013.01); *D06P 1/5257* (2013.01); *D06P 1/54* (2013.01)

(58) Field of Classification Search

CPC . D04H 1/488; D04H 1/64; D04H 1/66; D06P 1/54; D06P 1/44; D06P 1/5257

See application file for complete search history.

(56) References Cited

U.S. PATENT DOCUMENTS 4,830,900 A * 5/1989 Sumii ..... B32B 5/02 428/195.1
6,716,776 B2 * 4/2004 Morishima ..... D01F 8/06 428/904

FOREIGN PATENT DOCUMENTS

| | | | |
|---|---|---|---|
| JP | 2012-179985 | A | 9/2012 |
| JP | 2012-201172 | A | 10/2012 |
| JP | 2013-194348 | A | 9/2013 |
| JP | 2014-051268 | A | 3/2014 |

* cited by examiner

*Primary Examiner* — Elizabeth M Cole
(74) *Attorney, Agent, or Firm* — Heslin Rothenberg Farley & Mesiti P.C.

(57) ABSTRACT

An object of the present invention is to provide a nonwoven fabric for molding with a good moldability, even when it is a binder-bonded and/or printed nonwoven fabric; and a surface material for automobile. In the nonwoven fabric for molding of the present invention, a binder for fiber bonding and/or a printing is applied to a fiber web, and a stress at 20% elongation in the cross direction of the nonwoven fabric for molding is 24 to 36 N/3-cm-width. The surface material for automobile of the present invention consists of the nonwoven fabric for molding. In the present invention, it has been found that a good moldability is achieved when a stress at 20% elongation in the cross direction is 24 to 36 N/3-cm-width.

6 Claims, 1 Drawing Sheet

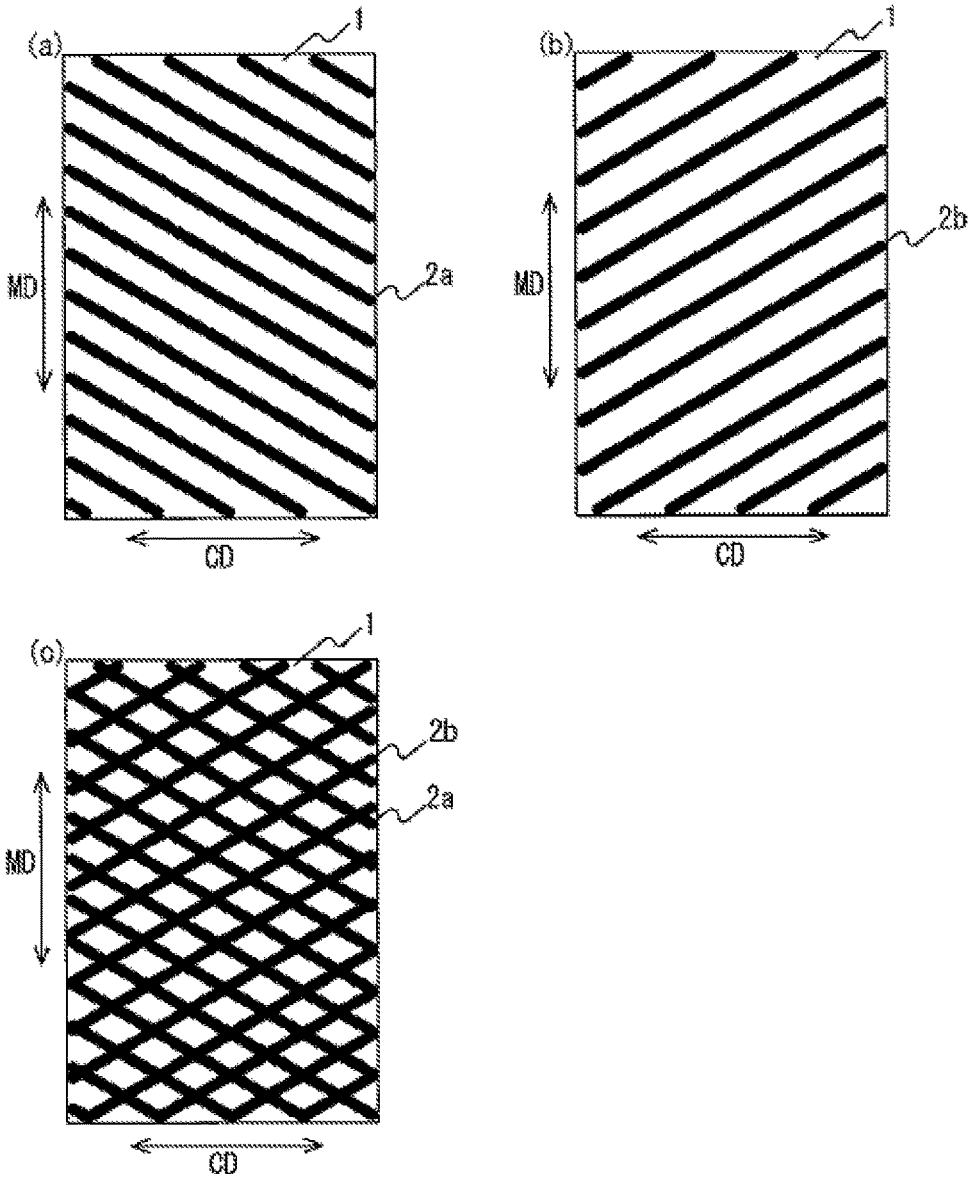
(a)
1
2a
MD
CD
(b)
1
2b
MD
CD
(c)
1
2b
2a
MD
CD

NONWOVEN FABRIC FOR MOLDING AND SURFACE MATERIAL FOR AUTOMOBILE

CROSS REFERENCE TO RELATED APPLICATIONS

This application claims priority to Japanese Patent Application No. 2015-030215, filed on Feb. 19, 2015. The entire contents of the prior application are hereby incorporated herein by reference.

TECHNICAL FIELD

The present invention relates to a nonwoven fabric for molding and a surface material for automobile. The nonwoven fabric for molding of the present invention can be suitably used as a surface material for automobile interior materials, in particular, headliner materials, pillar materials, door trim materials, rear package materials, or the like.

BACKGROUND ART

Conventionally, surface materials for automobile interior to which print processing is applied have been proposed in order to improve decorativeness. For example, the applicant of the present application has proposed a decorative fiber sheet for automobile to which print having color differences is applied (Patent literature 1), a decorative fiber sheet for automobile to which print having brightness differences is applied (Patent literature 2), a decorative fiber sheet to which print is applied so that brightness changes (Patent literature 3), and a decorative fiber sheet for automobile to which at least two kinds of print with different brightness are applied (Patent literature 4), so that it is possible to feel a wide interior space and not feel tightness. These decorative fiber sheets had a good decorativeness, and did not provide a sense of tightness. However, when the decorative fiber sheets are used, they usually have to be molded to conform to various applications, but they had a case of poor moldability.

Such a moldability problem was not limited to the case where the decorative fiber sheets were used for automotive applications, and occurred in other applications, such as partition applications. Further, this moldability problem also arose when a nonwoven fabric, to which print was not applied, but which was bonded with a binder to improve abrasion resistance, was used as a decorative fiber sheet such as a surface material for automobile.

CITATION LIST

Patent Literature

[Patent literature 1] JP 2012-179985 A
[Patent literature 2] JP 2012-201172 A
[Patent literature 3] JP 2013-194348 A
[Patent literature 4] JP 2014-51268 A

SUMMARY OF INVENTION

Technical Problem

The present invention has been completed under these circumstances, and an object of the present invention is to provide a nonwoven fabric for molding with a good moldability, even when it is a binder-bonded and/or printed nonwoven fabric; and a surface material for automobile.

Solution to Problem

The invention set forth in claim 1 is "a nonwoven fabric for molding, characterized in that a binder for fiber bonding and/or a printing is applied to a fiber web, and a stress at 20% elongation in the cross direction of the nonwoven fabric for molding is 24 to 36 N/3-cm-width".

The invention set forth in claim 2 is "A surface material for automobile, characterized by consisting of the nonwoven fabric for molding according to claim 1".

Advantageous Effects of Invention

The invention set forth in claim 1 has a good moldability, due to stress at 20% elongation in the cross direction of the nonwoven fabric for molding of 24 to 36 N/3-cm-width.

The invention set forth in claim 2 has a good moldability, because the nonwoven fabric for molding is used as surface materials for automobile.

BRIEF DESCRIPTION OF THE DRAWINGS

FIG. 1

(a) A plane view which shows a print pattern of the first resin solution in the Examples.
(b) A plane view which shows a print pattern of the second resin solution in the Examples.
(c) A plane view which shows a print pattern on nonwoven fabrics for molding in the Examples.

DESCRIPTION OF EMBODIMENTS

The nonwoven fabric for molding of the present invention is one in which a binder for fiber bonding and/or a printing is applied to a fiber web, and the stress at 20% elongation in the cross direction of the nonwoven fabric for molding is 24 to 36 N/3-cm-width.

Fibers which constitute the nonwoven fabric for molding of the present invention, i.e., fibers which constitute the fiber web, are not particularly limited. Examples of the fibers include synthetic fibers, such as polyester fibers, polyolefin fibers, polyvinylidene chloride fibers, polyvinyl chloride fibers, acrylic fibers, polyurethane fibers, nylon fibers, vinylon fibers, and polylactic acid fibers; regenerated fibers, such as rayon fibers, polynosic fibers, cupra fibers, and lyocell fibers; semi-synthetic fibers, such as acetate fibers and triacetate fibers; plant fibers, such as cotton and hemp; and animal fibers, such as wool and silk. Of these, polyester fibers are preferable, because heat resistance, weather resistance, antifouling properties, and the like are good, and it is more preferable that polyester fibers account for 100%. Further, the constituent fiber is not limited to a fiber consisting of a single resin component, but may be a fiber consisting of two or more resin components. For example, the constituent fiber may be a composite fiber in which the arrangement in the cross section of the fiber is a side-by-side type, a sheath-core type, an eccentric sheath-core type, or the like. When it is a side-by-side type or an eccentric sheath-core type, crimps can be generated by the action of heat, and therefore, a soft, nonwoven fabric for molding may be produced. When it is a sheath-core type, the fibers can be bonded by the action of heat, while maintaining the fiber form, and thus, a nonwoven fabric for molding with a good abrasion resistance may be produced.

Hydrophilic fibers prepared by imparting hydrophilic properties to hydrophobic fibers (for example, polyester fibers, polyolefin fibers, polyvinylidene chloride fibers, polyvinyl chloride fibers, acrylic fibers, polyurethane fibers, polylactic acid fibers, or the like) are preferable, because, due to good conformability with a resin solution, when the fiber web is impregnated with the resin solution, or the resin solution is applied to the fiber web, the resin solution immediately enters the fiber web in the plane direction and the thickness direction, and can exist throughout the fiber web, and as a result, the fiber web can be uniformly molded without the occurrence of wrinkles or fine unevenness.

This method of imparting hydrophilic properties is not particularly limited, but examples thereof include an application treatment with a surfactant agent, a sulfonating treatment, a treatment with fluorine gas, a graft polymerization treatment with vinyl monomers, a discharging treatment, and an application treatment with a hydrophilic resin. Of these, the application treatment with a surfactant agent is preferable, because hydrophilic properties can be imparted without damaging the strength of hydrophobic fibers. That is to say, since hydrophobic fibers generally have hydrophobic groups on their surface, the addition of a surfactant renders the fiber surface hydrophilic by covering it with hydrophilic groups of the surfactant, without physical actions, and therefore, hydrophilic properties can be imparted without impairing the strength of hydrophobic fibers. As the surfactant agent, a nonionic surfactant is preferable, because it has a high hydrophilicity.

The imparting of hydrophilicity can be carried out with respect to fibers before forming a fiber web, or alternatively, with respect to fibers after forming a fiber web, i.e., a fiber web. It is preferable to form a fiber web after imparting hydrophilicity to fibers, because hydrophilicity can be uniformly imparted throughout the fiber web, and as a result, a binder resin and/or a print resin can be easily immobilized throughout the plane direction and the thickness direction.

It is preferable that the nonwoven fabric for molding does not contain elastomeric fibers as a constituent fiber. This is because elastomeric fibers have a poor heat resistance and a poor versatility, and in particular, when the nonwoven fabric for molding is used as surface materials for automobile, it cannot withstand use.

The fineness of the fibers which constitute the fiber web is not particularly limited, but it is preferably 4.4 dtex or less, more preferably 3.3 dtex or less, and still more preferably 2.2 dtex or less, so that it does not become transparent during molding. The lower limit of the fineness of the fibers constituting the fiber web is not particularly limited, it is preferably 0.5 dtex or more, and more preferably 0.8 dtex or more, so that fibers are uniformly dispersed, and the nonwoven fabric has a uniform texture and a good followability during molding. When the fiber web contains two kinds of fibers with different fineness, it is preferable that the average fineness calculated by the following equation is within the above-mentioned fineness range. When the fiber web contains three or more kinds of fibers with different fineness, it is preferable that the average fineness calculated in a similar manner is within the above-mentioned fineness range.

$$Fav=1/[(Pa/100)/Fa+(Pb/100)/Fb]$$

wherein Fav is an average fineness (unit: dtex), Pa is a mass percentage (unit: mass %) of fiber A, Fa is a fineness (unit: dtex) of fiber A, Pb is a mass percentage (unit: mass %) of fiber B, and Fb is a fineness (unit: dtex) of fiber B.

The fiber length of the fibers which constitute the fiber web is not particularly limited, but it is preferably 30 to 80 mm, more preferably 40 to 70 mm, and still more preferably 50 to 60 mm, so that the nonwoven fabric for molding has a uniform texture.

The "fineness" as used herein means a value obtained by Method A defined in JIS L 1015:1999, 8.5.1 (Fineness based on corrected weight). The "fiber length" as used herein means a value obtained by JIS L 1015:1999, 8.4.1 [Corrected staple diagram method (Method B)].

The number of crimps of the fibers which constitute the fiber web is not particularly limited, but it is preferably 5 to 30 peaks/25 mm, and more preferably 14 to 24 peaks/25 mm, so that the nonwoven fabric for molding has a uniform texture. The "number of crimps" as used herein means a value obtained by a method defined in JIS L1015:2010, 8.12.1 (Number of crimps).

The fibers constituting the fiber web, which is used in preparing the nonwoven fabric for molding of the present invention, may be colored with pigments and/or dyes. The design of the nonwoven fabric for molding can be improved by using such colored fibers. In particular, it is preferable, when the nonwoven fabric for molding is used as surface materials for automobile. This coloring may be carried out by kneading fibers with pigments, or alternatively, by forming a fiber web, followed by the coloring of the fiber web with pigments and/or dyes.

The fiber web in the present invention may contain two or more kinds of fibers different in the kind and/or number of resin components, fineness, fiber length, the presence or absence, color, kind, and/or amount of pigments or dyes.

The fiber web may be formed in any manner, for example, a dry-laid method, such as a carding method, an air-laid method, or the like, a wet-laid method, or a direct method, such as a spunbond method or the like. Since it is preferable that the fiber web has a certain thickness from the viewpoint of moldability, it is preferable that the fiber web is formed by the dry-laid method.

The orientation direction of the fibers constituting the fiber web used in the present invention is not particularly limited, but it is preferable that the fibers are relatively oriented in the machine direction, so that the nonwoven fabric for molding of the present invention extends to some extent in the cross direction, and is easily molded.

It is preferable that the fiber web in the present invention is entangled by needles or a water jet, because it has a good texture and a good form stability. Of such entangling methods, the entanglement with needles, in which the fiber web can be entangled while maintaining the thickness, and it has a good moldability, is preferable. The conditions for entanglement may be appropriately determined in view of texture and form stability, and is not particularly limited. When the fiber web is entangled by needles, which is preferable, it is preferable to be entangled at a needle density of 100 to 1000 needles/$cm^2$, and it is more preferable to be entangled at 200 to 600 needles/$cm^2$. When the fibers are entangled by stitch bonding, the entanglement strength of a stitch bonded portion is extremely higher than that of a portion not stitch bonded, and the moldability tends to become poor, and therefore, it is preferable not to be stitch bonded.

Since the mass per unit area of the fiber web varies depending on the strength required for the nonwoven fabric for molding, the type of fibers, or the like, it is not particularly limited, but is preferably 50 to 500 g/$m^2$, more preferably 100 to 250 g/$m^2$, and still more preferably 150 to 200 g/$m^2$.

The nonwoven fabric for molding of the present invention is one in which a binder for fiber bonding and/or a printing is applied to the fiber web as described above. When the binder for fiber bonding is applied, it may be a nonwoven fabric for molding having a good abrasion resistance. When the printing is applied, it may be a nonwoven fabric for molding that is excellent in design properties. Therefore, it is preferable that the binder for fiber bonding and the printing are applied. When the binder for fiber bonding and the printing are applied as above, it is preferable that the printing is applied on the surface which has become smooth by the binder for fiber bonding, and the design is clear and it is excellent in design properties.

The binder for fiber bonding is not particularly limited, but examples thereof include vinyl chloride resins, acrylic resins, and polyester resins. Of these, the acrylic resins (in particular, self-crosslinking acrylic resins), which become moderately softened during molding, have a good followability to molds, and hardly generate wrinkles or fine unevenness, are preferable. Of the acrylic resins, a soft acrylic resin having a low glass transition temperature is preferable, because it can easily stretch, and has a good moldability. More particularly, the glass transition temperature is preferably 50° C. or less, more preferably 30° C. or less, still more preferably 0° C. or less, still more preferably −10° C. or less, and still more preferably −15° C. or less. On the other hand, since the abrasion resistance tends to become poor when the glass transition temperature is too low, it is preferably −50° C. or more. The term "glass transition temperature" as used herein means a temperature at an intersection of a tangent line of the base line in a DTA (differential thermal analyzer) curve measured using a DTA and another tangent line of the steep descent position of the endothermic region by glass transition.

The amount of the binder for fiber bonding is not particularly limited, but it is preferably 10 g/m$^2$ or less, more preferably 8 g/m$^2$ or less, and still more preferably 6 g/m$^2$ or less, so as not to impair the moldability of the nonwoven fabric for molding. On the other hand, it is preferably 1 g/m$^2$ or more, so that it is excellent in abrasion resistance as an action of the binder for fiber bonding.

It is preferable that the binder for fiber bonding is applied throughout the plane direction and the thickness direction of the fiber web, and bonded to the intersections of the fibers so that it is excellent in abrasion resistance of the nonwoven fabric for molding.

The binder for fiber bonding may contain functional materials. For example, a binder for fiber bonding containing a pigment and/or a dye can improve design properties, a binder for fiber bonding containing a flame retardant can impart flame retardancy, and a binder for fiber bonding containing a water repellent and/or an oil repellent can impart water repellency and/or oil repellency.

Another resin which constitutes the printing is not particularly limited, but examples thereof include vinyl chloride resins, acrylic resins, and polyester resins. Of these, the acrylic resins (in particular, self-crosslinking acrylic resins), which become moderately softened during molding, have a good followability to molds, and seldom generate wrinkles or fine unevenness, are preferable. Of the acrylic resins, a soft acrylic resin having a low glass transition temperature is preferable, because it can easily stretch, and has a good moldability. More particularly, the glass transition temperature is preferably 50° C. or less, more preferably 30° C. or less, and still more preferably 0° C. or less. On the other hand, since the abrasion resistance tends to become poor when the glass transition temperature is too low, it is preferably −50° C. or more.

The amount of the printing is not particularly limited, but it is preferably 15 g/m$^2$ or less, more preferably 13 g/m$^2$ or less, and still more preferably 11 g/m$^2$ or less, so as not to impair the moldability of the nonwoven fabric for molding. On the other hand, it is preferably 1 g/m$^2$ or more, so as not to impair the design properties of the printing.

The printing may be any pattern, and is not particularly limited. For example, the printing may be a pattern in which pattern units, such as point-like such as a circle or square, linear, curved, characters, figures, symbols, pictures, or the like, are regularly or irregularly arranged. The pattern units may be the same, or a combination of different pattern units.

The printing may also contain functional materials. For example, a printing containing a pigment and/or a dye can further improve design properties, a printing containing a flame retardant can impart flame retardancy, and a printing containing a water repellent and/or an oil repellent can impart water repellency and/or oil repellency.

Further, similar to the conventional, at least two types of prints may be applied, so as to have color differences, so as to have brightness differences, or so as to change brightness.

The nonwoven fabric for molding of the present invention is one in which a binder for fiber bonding and/or a printing is applied to the fiber web as described above, and the inventors have found that when the stress at 20% elongation in the cross direction is 24 to 36 N/3-cm-width, it shows a good moldability. It is preferably 26 to 34 N/3-cm-width, and more preferably 27 to 33 N/3-cm-width. In connection with this, the reason for considering "the stress at 20% elongation" of the nonwoven fabric for molding is that when a nonwoven fabric for molding is molded along molds, the elongation of the nonwoven fabric for molding is at most about 20% in many cases.

Further, the reason for considering "the cross direction" of the nonwoven fabric for molding is that molding is carried out in a state where the terminal portions of the nonwoven fabric for molding in the cross direction are fixed during molding in many cases, and the nonwoven fabric for molding tends to be extended in the cross direction during molding. The term "cross direction" as used herein means the width direction during the production of the nonwoven fabric for molding.

On the other hand, the stress at 20% elongation in the machine direction of the nonwoven fabric for molding is preferably 40 to 80 N/3-cm-width, more preferably 45 to 75 N/3-cm-width, and still more preferably 50 to 70 N/3-cm-width, so that it shows a good moldability. The term "machine direction" as used herein means the production direction during the production of the nonwoven fabric for molding.

The "stress at 20% elongation" in the present invention is a value obtained through the following method.

(1) Three rectangular test pieces (3 cm×20 cm) are taken from a nonwoven fabric for molding. For example, when the stress at 20% elongation in the cross direction is measured, three rectangular test pieces of 3 cm in the machine direction and 20 cm in the cross direction are taken.

(2) The test piece is fixed between chucks (distance: 10 cm) of a tensile strength tester (manufactured by Orientec Co., Ltd., Tensilon UTMIII-100). The test piece is pulled at a tensile rate of 20 cm/min, and a stress is measured when the distance between the chucks becomes 12 cm (20% elongation between the chucks).

(3) The above measurement of (1) to (2) is repeated with respect to three test pieces to measure the stress, and the arithmetic average is regarded as the stress at 20% elongation.

The nonwoven fabric for molding of the present invention is one in which a binder for fiber bonding and/or a printing is applied to the fiber web as described above. It has a stress at 20% elongation in the cross direction of 24 to 36 N/3-cm-width, and the total amount of the binder for fiber bonding and the print resin is, so that it shows a good moldability, preferably 10 mass % or less, more preferably 9 mass % or less, and still more preferably 8 mass % or less, with respect to the total mass of the nonwoven fabric for molding.

The mass per unit area and the thickness of the nonwoven fabric for molding varies depending on its applications, and is not particularly limited. For example, when it is used as surface materials for automobile, the mass per unit area is preferably 50 to 525 g/m$^2$, more preferably 100 to 275 g/m$^2$, and still more preferably 150 to 225 g/m$^2$, so that it shows a good moldability. The thickness is preferably 0.5 to 3 mm, and more preferably 1 to 2 mm. The term "mass per unit area" as used herein means a mass per 1 m$^2$ of the broadest surface of the nonwoven fabric for molding or the like. The "thickness" as used herein means a thickness when 20 g/cm$^2$ is loaded.

Since the nonwoven fabric for molding of the present invention is excellent in moldability, it can be suitably used in applications that require molding. It can be suitably used, for example, as surface materials for automobile, surface materials for partitions, or a wall paper, in particular, surface materials for automobile, such as a headliner, a door side, a pillar garnish, a rear package, or the like.

The molding method is not particularly limited, but examples thereof include a molding method by heating and pressing using a pair of molds, a molding method by heating (for example, a hot air circulation heat treatment machine, a far-infrared heating machine, or the like) followed by pressing using a pair of molds around room temperature, and the like.

The nonwoven fabric for molding of the present invention can be produced, for example, as described below.

First, fibers which constitute a fiber web are prepared. The fibers are preferably composed of polyester fibers, and are more preferably composed of 100% of polyester fibers. As described above, it is preferable that the fibers do not contain elastomeric fibers having a poor heat resistance. The number of crimps of the fibers is preferably 5 to 30 peaks/25 mm, and more preferably 14 to 24 peaks/25 mm, so that a nonwoven fabric for molding having a uniform texture can be easily produced.

In connection with this, since hydrophobic fibers such as polyester fibers have a poor conformability with the binder for fiber bonding and/or the print resin, it is often difficult to be present in the plane direction and the thickness direction of the fiber web, and it often shows a poor moldability, and therefore, when hydrophobic fibers are used, it is preferable that hydrophilicity is imparted thereto.

Examples of a method of imparting hydrophilicity to hydrophobic fibers include an application treatment with a surfactant agent, a sulfonating treatment, a treatment with fluorine gas, a graft polymerization treatment with vinyl monomers, a discharging treatment, or an application treatment with a hydrophilic resin. Of these, the application treatment with a surfactant agent is preferable.

The application treatment with a surfactant agent, as a preferable method, may be carried out, for example, by dipping the hydrophobic fibers in a solution of an anionic surfactant agent (such as an alkali metal salt of a higher fatty acid, alkyl sulfonate, a salt of sulfosuccinate, or the like) or a nonionic surfactant agent (such as polyoxyethylene alkyl ether, polyoxyethylene alkylphenol ether, or the like), or coating or spraying the surfactant solution to the hydrophobic fibers. The nonionic surfactant agent is preferable, because it shows a high affinity to the binder resin solution or the print resin solution, as described below.

Next, the prepared fibers are used to form a fiber web. Examples of a forming method include a dry-laid method, such as a carding method, an air-laid method, or the like, a wet-laid method, or a direct method, such as a spunbond method or the like. The dry-laid method is preferable, because a nonwoven fabric for molding, which is relatively bulky and shows a good moldability, can be produced.

The orientation direction of the fibers constituting the fiber web is not particularly limited, but it is preferable that the fibers are relatively oriented in the machine direction, so that the nonwoven fabric for molding extends, to some extent, in the cross direction, and is easily molded. For example, it is preferable that the fibers are oriented in the production direction of the fiber web, or even when the fibers constituting the fiber web are oriented in the width direction by a cross-layer or the like, the fibers are oriented so that the angle (acute angle) with respect to the production direction becomes small.

Next, the resin solution of the binder for fiber bonding, and/or the resin solution for printing may be applied to the fiber web. It is preferable that the fiber web is entangled by needles or a water jet, because it has a good texture and a good form stability. In particular, the entanglement with needles is preferable, because the fiber web can be entangled while maintaining the thickness, and it hardly impairs the moldability. The conditions for entanglement are not particularly limited, but when the fiber web is entangled by needles, it is preferable to be entangled at a needle density of 100 to 1000 needles/cm$^2$, and it is more preferable to be entangled at 200 to 600 needles/cm$^2$. When the fibers are entangled by stitch bonding, the entanglement strength of a stitch bonded portion is extremely higher than that of a portion not stitch bonded, and the moldability tends to become poor, and therefore, it is preferable not to be stitch bonded.

In parallel, the resin solution of the binder for fiber bonding, and/or the resin solution for printing, which is to be applied to the fiber web, is prepared. The resins which constitute these resin solutions are not particularly limited, but as previously described, they are preferably acrylic resins (in particular, self-crosslinking acrylic resins). Of the acrylic resins, the glass transition temperature is preferably 50° C. or less, more preferably 30° C. or less, and still more preferably 0° C. or less, so that the glass transition temperature is low, and it is excellent in moldability.

These resin solutions may be those in which resins are dissolved, or those in which resins are dispersed. When the fiber web contain hydrophilic fibers, or fibers to which hydrophilicity is imparted, the solvent is preferably water or alcohols (for example, ethanol, methanol, or the like), or a mixed solvent thereof, so that the affinity to the hydrophilic fibers or the hydrophilicity-imparted fibers is improved. In particular, it is preferable that water is used as the solvent from the viewpoint of a production environment. These resin solutions may contain additional components other than the resins, for example, a thickener, a surfactant, a pH adjusting agent, a defoamer, a pigment, a dye, or the like. In particular, design properties can be improved by containing pigments or dyes in the resin solution for printing.

Next, the resin solution of the binder for fiber bonding, and/or the resin solution for printing is applied to the fiber web. When the fiber web contains hydrophilic fibers or hydrophilicity-imparted fibers, the affinity to the resin solutions is high, and therefore, the resin solutions penetrate into the thickness direction of the fiber web, and can exist throughout the thickness direction. In connection with this, the application of the resin solution for fiber bonding to the fiber web can be carried out, for example, by a method of dipping the fiber web in the resin solution, a method of coating the resin solution on the fiber web, a method of spraying the resin solution to the fiber web, or the like. Of these, the method of coating the resin solution on the fiber web is preferable, because a uniform application can be achieved even in small amounts. In particular, when the coating method is a method of coating the resin solution on the fiber web in a state where the resin solution is whipped, it is preferable, because a uniform application can be achieved even in smaller amounts, and a nonwoven fabric for molding with a good moldability can be obtained. More particularly, the amount of the binder for fiber bonding (resin solid content) is preferably 10 g/m$^2$ or less, more preferably 8 g/m$^2$ or less, and still more preferably 6 g/m$^2$ or less.

On the other hand, when the resin solution for printing is applied to the fiber web, the application can be carried out by a conventional method, such as a letterpress print, a planographic print, an intaglio print, a stencil print, or the like. Even in this case, the amount of the resin for printing (resin solid amount) is preferably 15 g/m$^2$ or less, more preferably 13 g/m$^2$ or less, and still more preferably 11 g/m$^2$ or less, so as not to impair the moldability.

In connection with this, the application of the resin solution of the binder for fiber bonding and/or the resin solution for printing is not limited to an application of either of the resin solutions, but both resin solutions may be applied. When both resin solutions are applied, it is preferable that after the resin solution for fiber bonding is applied, the resin solution for printing is printed, so as not to impair the design properties imparted by the printing of the resin solution for printing. In particular, it is preferable that after the binder for fiber bonding is applied to form a smooth surface, the resin solution for printing is printed on the binder-applied, smooth surface, because a nonwoven fabric for molding having a clear design and good design properties can be obtained. The application of the resin solution of the binder for fiber bonding and/or the resin solution for printing is not limited to an application in which each is once, but either of the resin solutions, or both resin solutions may be applied twice or more.

In the application of the resin solution of the binder for fiber bonding and/or the resin solution for printing, even when only one is applied, or even when both are applied, the total amount of the binder for fiber bonding (resin solid content) and the resin for printing (resin solid content) is preferably 10 mass % or less, more preferably 9 mass % or less, and still more preferably 8 mass % or less, with respect to the total mass of the nonwoven fabric for molding, so that it shows a good moldability.

Next, the fiber web to which the resin solutions are applied is dried to fix the resins, and the nonwoven fabric for molding of the present invention can be produced. When the resin for fiber bonding or the resin for printing contains a self-crosslinking acrylic resin, it is preferable that the degree of crosslinking of the resin for fiber bonding or the resin for printing is decreased, for example, by lowering the drying temperature, because a nonwoven fabric for molding, which is easily molded, can be easily produced.

The drying is not particularly limited, but it can be carried out, for example, by a method using a hot-air dryer, a method by infrared irradiation, a method using an oven, a method using a heating roll, or the like.

EXAMPLES

The present invention now will be further illustrated by, but is by no means limited to, the following Examples.

Example 1

After 100 mass % of spun-dyed polyester fibers (fineness::2.2 dtex, fiber length: 51 mm, and number of crimps: 18 peaks/25 mm) composed of a polyester resin colored in gray by kneading a pigment were opened using a card machine to form a fiber web, the fibers constituting the fiber web were crossed using a cross-layer with respect to the production direction to form a cross web. A needle punching treatment was carried out from one side of the cross web at a needle density of 400 needles/cm' to produce a needle punched web (mass per unit area: 180 g/m$^2$).

In parallel, a resin solution of a binder for fiber bonding was prepared in the following proportions.

(1) Self-crosslinking acrylic resin binder [VONCOAT (registered trademark) AB-886, manufactured by DIC Corporation, Tg: −40° C.]. . . 5.4 parts
(2) Surfactant [NEOGEN (registered trademark) S-20D, manufactured by DKS Co., Ltd.]. . . 1.0 parts
(3) Thickener [CELLOGEN (registered trademark) WS-C, manufactured by DKS Co., Ltd.]. . . 0.2 parts
(4) Ammonia water . . . 0 1 parts
(5) Water . . . 93.3 parts The needle punched web was fully applied with the resin solution of the binder for fiber bonding, which had been whipped, on the opposite side to the needling side of the needle punched web, and dried using a can dryer at a temperature of 160° C. to produce a binder-bonded web (resin solid content: 5 g/m$^2$), which was bonded throughout the plane direction and the thickness direction.

Further, the first and second resin solutions for printing were prepared in the following proportions.

(First Resin Solution)
(1) Thickener [Carbopol (registered trademark) 940, manufactured by Lubrizol Corporation]. . . 0.36 parts
(2) Defoamer [Shin-Etsu (registered trademark) Silicone KM-73, manufactured by Shin-Etsu Chemical Co., Ltd.]. . . 0.5 parts
(3) Self-crosslinking acrylic resin binder [VONCOAT (registered trademark) E-240N, manufactured by DIC Corporation, Tg: −5° C.]. . . 25 parts
(4) Black pigment [R. W. BLACK RC(V), manufactured by DIC Corporation]. . . 0.032 parts
(5) Yellow pigment [R. W. YELLOW FF3R, manufactured by DIC Corporation]. . . 0.086 parts
(6) Brown pigment [R. W. BROWN FFR, manufactured by DIC Corporation]. . . 0.017 parts
(7) Thickener [Nikasol (registered trademark) VT-253, manufactured by NIPPON CARBIDE INDUSTRIES CO., INC.]. . . 1 part
(8) 25% Ammonia water . . . 1 part
(9) Water . . . 72.005 parts (Second Resin Solution)
(1) Thickener [Carbopol (registered trademark) 940, manufactured by Lubrizol Corporation]. . . 0.33 parts
(2) Defoamer [Shin-Etsu (registered trademark) Silicone KM-73, manufactured by Shin-Etsu Chemical Co., Ltd.]. . . 0.5 parts
(3) Self-crosslinking acrylic resin binder [VONCOAT (registered trademark) E-240N, manufactured by DIC Corporation, Tg: −5° C.]. . . 15 parts
(4) White pigment [Dainichiseika EP 677 WHITE Kai, manufactured by Dainichiseika Color & Chemicals Mfg. Co., Ltd.]. . . 0.1 parts
(5) Mold release agent [Toshiba Silicone YMR-7212, Momentive Performance Materials Japan Inc.]. . . 2.0 parts
(6) Thickener [Nikasol (registered trademark) VT-253, manufactured by NIPPON CARBIDE INDUSTRIES CO., INC.]. . . 1 part
(7) 25% Ammonia water . . . 1 part
(8) Water . . . 80.07 parts On the applied surface of the binder-bonded web with the resin solution of the binder for fiber bonding, pattern units (line width: 0.2 mm, line spacing: 1.2 mm), which linearly extended in an upper left oblique direction at an acute angle of 30° with respect to the cross direction (CD), were printed with the first resin solution for printing, using a stencil printing machine, as shown in FIG. 1(*a*), and then, pattern units (line width: 0.2 mm, line spacing: 1.2 mm), which linearly extended in an upper right oblique direction at an acute angle of 30° with respect to the cross direction (CD), were printed with the second resin solution for printing, using a stencil printing machine, as shown in FIG. 1(*b*). The web was dried using a heat dryer, in which the temperature was raised from 160° C. to 180° C., to produce a nonwoven fabric for molding (mass per unit area: 195 g/m$^2$, thickness: 1.3 mm, solid content of resin for printing: 10 g/m$^2$, stress at 20% elongation in the machine direction: 52 N/3-cm-width, stress at 20% elongation in the cross direction: 31 N/3-cm-width) having a lattice pattern, as shown in FIG. 1(*c*).

Example 2

After 100 mass % of spun-dyed polyester fibers (fineness::2.2 dtex, fiber length: 51 mm, and number of crimps: 18 peaks/25 mm) composed of a polyester resin colored in gray by kneading a pigment were opened using a card machine to form a fiber web, the fibers constituting the fiber web were crossed using a cross-layer with respect to the production direction to form a cross web. A needle punching treatment was carried out from one side of the cross web at a needle density of 400 needles/cm$^2$ to produce a needle punched web (mass per unit area: 170 g/m$^2$).

In parallel, a resin solution of a binder for fiber bonding was prepared in the following proportions.

(1) Self-crosslinking acrylic resin binder [VONCOAT (registered trademark) DS-23, manufactured by DIC Corporation, Tg: −15° C.]. . . 12 parts
(2) Surfactant [NEOGEN (registered trademark) S-20D, manufactured by DKS Co., Ltd.]. . . 0.3 parts
(3) Thickener [CELLOGEN (registered trademark) WS-C, manufactured by DKS Co., Ltd.]. . . 0.2 parts
(4) Ammonia water . . . 0.1 parts
(5) Water . . . 874 parts The needle punched web was fully applied with the resin solution of the binder for fiber bonding, which had been whipped, on the opposite side to the needling side of the needle punched web, and dried using a can dryer at a temperature of 160° C. to produce a binder-bonded web (resin solid content: 10 g/m$^2$), which was bonded throughout the plane direction and the thickness direction.

Further, the first and second resin solutions for printing were prepared in the following proportions.

(First Resin Solution)

(1) Thickener [Carbopol (registered trademark) 940, manufactured by Lubrizol Corporation]. . . 0.36 parts
(2) Defoamer [Shin-Etsu (registered trademark) Silicone KM-73, manufactured by Shin-Etsu Chemical Co., Ltd.]. . . 05 parts
(3) Self-crosslinking acrylic resin binder [VONCOAT (registered trademark) E-240N, manufactured by DIC Corporation, Tg: −5° C.]. . . 25 parts
(4) Black pigment [R. W. BLACK RC(V), manufactured by DIC Corporation]. . . 0.031 parts
(5) Yellow pigment [R. W. YELLOW FF3R, manufactured by DIC Corporation]. . . 0.086 parts
(6) Brown pigment [R. W. BROWN FFR, manufactured by DIC Corporation]. . . 0.017 parts
(7) Thickener [Nikasol (registered trademark) VT-253, manufactured by NIPPON CARBIDE INDUSTRIES CO., INC.]. . . 1 part
(8) 25% Ammonia water . . . 1 part
(9) Water . . . 72.006 parts (Second Resin Solution)

(1) Thickener [Carbopol (registered trademark) 940, manufactured by Lubrizol Corporation]. . . 0.33 parts
(2) Defoamer [Shin-Etsu (registered trademark) Silicone KM-73, manufactured by Shin-Etsu Chemical Co., Ltd.]. . . 05 parts
(3) Self-crosslinking acrylic resin binder [VONCOAT (registered trademark) E-240N, manufactured by DIC Corporation, Tg: −5° C.]. . . 15 parts
(4) White pigment [R. W. WHITE PASTE 69, manufactured by DIC Corporation]. . . 0.3 parts
(5) Mold release agent [Toshiba Silicone YMR-7212, Momentive Performance Materials Japan Inc.]. . . 2.0 parts
(6) Thickener [Nikasol (registered trademark) VT-253, manufactured by NIPPON CARBIDE INDUSTRIES CO., INC.]. . . 1 part
(7) 25% Ammonia water . . . 1 part
(8) Water . . . 79.87 parts On the applied surface of the binder-bonded web with the resin solution of the binder for fiber bonding, pattern units (line width: 0.2 mm, line spacing: 1.2 mm), which linearly extended in an upper left oblique direction at an acute angle of 30° with respect to the cross direction (CD), were printed with the first resin solution for printing, using a stencil printing machine, as shown in FIG. 1(*a*), and then, pattern units (line width: 0.2 mm, line spacing: 1.2 mm), which linearly extended in an upper right oblique direction at an acute angle of 30° with respect to the cross direction (CD), were printed with the second resin solution for printing, using a stencil printing machine, as shown in FIG. 1(*b*). The web was dried using a heat dryer, in which the temperature was raised from 160° C. to 200° C., to produce a nonwoven fabric for molding (mass per unit area: 195 g/m$^2$, thickness: 1.6 mm, solid content of resin for printing: 15 g/m$^2$, stress at 20% elongation in the machine direction: 68 N/3-cm-width, stress at 20% elongation in the cross direction: 36 N/3-cm-width) having a lattice pattern, as shown in FIG. 1(*c*).

Example 3

After 100 mass % of spun-dyed polyester fibers (fineness: 2.2 dtex, fiber length: 51 mm, and number of crimps: 18 peaks/25 mm) composed of a polyester resin colored in gray by kneading a pigment were opened using a card machine to form a fiber web, the fibers constituting the fiber web were crossed using a cross-layer with respect to the production direction to form a cross web. A needle punching treatment was carried out from one side of the cross web at a needle density of 400 needles/cm$^2$ to produce a needle punched web (mass per unit area: 173 g/m$^2$).

In parallel, a resin solution of a binder for fiber bonding was prepared in the following proportions.

(1) Self-crosslinking acrylic resin binder [VONCOAT (registered trademark) DS-23, manufactured by DIC Corporation, Tg:−15° C.]. . . 7.0 parts
(2) Penetrant [MARPOMERCE (registered trademark) OT, manufactured by Matsumoto Yushi-Seiyaku Co., Ltd.]. . . 0.3 parts
(3) Thickener [CELLOGEN (registered trademark) WS-C, manufactured by DKS Co., Ltd.]. . . 0.1 parts
(4) Ammonia water . . . 0 1 parts
(5) Water . . . 92.5 parts The needle punched web was fully applied with the resin solution of the binder for fiber bonding, which had been whipped, on the opposite side to the needling side of the needle punched web, and dried using a can dryer at a temperature of 160° C. to produce a binder-bonded web (resin solid content: 7 g/m$^2$), which was bonded throughout the plane direction and the thickness direction.

Further, the first and second resin solutions for printing were prepared in the following proportions.

(First Resin Solution)

(1) Thickener [Carbopol (registered trademark) 940, manufactured by Lubrizol Corporation]. . . 0.39 parts
(2) Defoamer [Shin-Etsu (registered trademark) Silicone KM-73, manufactured by Shin-Etsu Chemical Co., Ltd.]. . . 05 parts
(3) Self-crosslinking acrylic resin binder [VONCOAT (registered trademark) AB-886, manufactured by DIC Corporation, Tg: −40° C.]. . . 16 parts
(4) Self-crosslinking acrylic resin binder [VONCOAT (registered trademark) AN-1190S, manufactured by DIC Corporation, Tg: +° C.]. . . 7.2 parts
(5) Black pigment [R. W. BLACK RC(V), manufactured by DIC Corporation]. . . 0.031 parts
(6) Yellow pigment [R. W. YELLOW FF3R, manufactured by DIC Corporation]. . . 0086 parts
(7) Brown pigment [R. W. BROWN FFR, manufactured by DIC Corporation]. . . 0.017 parts
(8) Thickener [Nikasol (registered trademark) VT-253, manufactured by NIPPON CARBIDE INDUSTRIES CO., INC.]. . . 1 part
(9) 25% Ammonia water . . . 1 part
(10) Water . . . 73.776 parts (Second Resin Solution)

(1) Thickener [Carbopol (registered trademark) 940, manufactured by Lubrizol Corporation]. . . 0.39 parts
(2) Defoamer [Shin-Etsu (registered trademark) Silicone KM-73, manufactured by Shin-Etsu Chemical Co., Ltd.]. . . 0.5 parts
(3) Self-crosslinking acrylic resin binder [VONCOAT (registered trademark) AB-886, manufactured by DIC Corporation, Tg: −40° C.]. . . 9.5 parts
(4) Self-crosslinking acrylic resin binder [VONCOAT (registered trademark) AN-1190S, manufactured by DIC Corporation, Tg: +° C.]. . . 4.5 parts
(5) White pigment [R. W. WHITE PASTE 69, manufactured by DIC Corporation]. . . 0.3 parts
(6) Mold release agent [Toshiba Silicone YMR-7212, Momentive Performance Materials Japan Inc.]. . . 2.0 parts
(7) Thickener [Nikasol (registered trademark) VT-253, manufactured by NIPPON CARBIDE INDUSTRIES CO., INC.]. . . 1 part
(8) 25% Ammonia water . . . 1 part
(9)Water . . . 80.81 parts On the applied surface of the binder-bonded web with the resin solution of the binder for fiber bonding, pattern units (line width: 0.2 mm, line spacing: 1.2 mm), which linearly extended in an upper left oblique direction at an acute angle of 30° with respect to the cross direction (CD), were printed with the first resin solution for printing, using a stencil printing machine, as shown in FIG. 1(*a*), and then, pattern units (line width: 0.2 mm, line spacing: 1.2 mm), which linearly extended in an upper right oblique direction at an acute angle of 30° with respect to the cross direction (CD), were printed with the second resin solution for printing, using a stencil printing machine, as shown in FIG. 1(*b*). The web was dried using a heat dryer at a temperature of 180° C. to produce a nonwoven fabric for molding (mass per unit area: 195 g/m$^2$, thickness: 1.4 mm, solid content of resin for printing: 15 g/m$^2$, stress at 20% elongation in the machine direction: 51 N/3-cm-width, stress at 20% elongation in the cross direction: 24 N/3-cm-width) having a lattice pattern, as shown in FIG. 1(*c*).

Comparative Example 1

A nonwoven fabric for molding (mass per unit area: 205 g/m$^2$, thickness: 1.4 mm, solid content of binder resin for fiber bonding: 5 g/m$^2$, solid content of resin for printing: 10 g/m$^2$, stress at 20% elongation in the machine direction: 79 N/3-cm-width, stress at 20% elongation in the cross direction: 22 N/3-cm-width) having a lattice pattern, as shown in FIG. 1(*c*), was produced by repeating the procedure described in Example 1, except that the crossing angle, when the fibers constituting the fiber web, which had been opened using a card machine, were crossed using a cross-layer with respect to the production direction to form a cross web, was increased, in comparison with the crossing angle of Example 1, to form a fiber web having a mass per unit area of 190 g/m$^2$, in which the fibers constituting the fiber web became more oriented in the cross direction; and except that the web after printing with the second resin solution was dried using a heat dryer in which the temperature was raised from 160° C. to 200° C.

Comparative Example 2

A needle punched web (mass per unit area: 165 g/m$^2$) was produced in a similar manner to the procedure described in Example 1.

In parallel, a resin solution of a binder for fiber bonding was prepared in the following proportions.

(1) Self-crosslinking acrylic resin binder [VONCOAT (registered trademark) DS-23, manufactured by DIC Corporation, Tg: −15° C.]. . . 20 parts
(2) Surfactant [NEOGEN (registered trademark) S-20D, manufactured by DKS Co., Ltd.]. . . 0.5 parts
(3) Thickener [CELLOGEN (registered trademark) WS-C, manufactured by DKS Co., Ltd.]. . . 0.2 parts
(4) Ammonia water . . . 0.1 parts
(5) Water . . . 79.2 parts The needle punched web was fully applied with the resin solution of the binder for fiber bonding, which had been whipped, on the opposite side to the needling side of the needle punched web, and dried using a can dryer at a temperature of 160° C. to produce a binder-bonded web (resin solid content: 15 g/m$^2$), which was bonded throughout the plane direction and the thickness direction.

On the applied surface of the binder-bonded web with the resin solution of the binder for fiber bonding, the same first and second resin solutions for printing as those described in Example 3 were printed in a similar manner to that described in Example 3, and dried using a heat dryer at a temperature of 200° C. to produce a nonwoven fabric for molding (mass per unit area: 195 g/m$^2$, thickness: 1.5 mm, solid content of resin for printing: 15 g/m$^2$, stress at 20% elongation in the machine direction: 70 N/3-cm-width, stress at 20% elongation in the cross direction: 43 N/3-cm-width) having a lattice pattern, as shown in FIG. 1(*c*).

(Evaluation for Molding)

The nonwoven fabrics for molding were laminated with a urethane base material, and pressurized for several tens of seconds, using a pair of upper and lower molds heated at about 120 to 140° C., to mold each laminate. Each molded laminate was removed from the molds, and the appearance of the surface of each nonwoven fabric for molding was visually evaluated based on the following criteria. The results are shown in Table 1.

Good: Wrinkles and unevenness are not observed, and moldability is good.

Poor: Wrinkles and/or unevenness is observed, and moldability is poor.

TABLE 1

| | | Unit | Comp. Ex. 2 | Ex. 2 | Ex. 1 | Ex. 3 | Comp. Ex. 1 |
|---|---|---|---|---|---|---|---|
| | A | $g/m^2$ | 165 | 170 | 180 | 173 | 190 |
| B | B1 | $g/m^2$ | 15 | 10 | 5 | 7 | 5 |
| | B2 | ° C. | −15 | −15 | −40 | −15 | −40 |
| C | C1# | $g/m^2$ | 7.5/7.5 | 7.5/7.5 | 5/5 | 7.5/7.5 | 5/5 |
| | C2# | ° C. | +30, −40/ +30, −40 | −5/−5 | −5/−5 | +30, −40/ +30, −40 | −5/−5 |
| | D | ° C. | 200 | 160-200 | 160-180 | 180 | 160-200 |
| E | E1 | $g/m^2$ | 195 | 195 | 195 | 195 | 195 |
| | E2 | mm | 1.5 | 1.6 | 1.3 | 1.4 | 1.4 |
| | E3 | N/3 cm-width | 70 | 68 | 52 | 51 | 79 |
| | E4 | N/3 cm-width | 43 | 36 | 31 | 24 | 22 |
| | E5 | | Poor | Good | Good | Good | Poor |

A: Mass per unit area of fiber web
B: Binder for fiber bonding
B1: Mass per unit area
B2: Glass transition temperature
C: Resin solution for printing
C1: Mass per unit area
C2: Glass transition temperature
#: First resin solution/second resin solution
D: Drying temperature after printing
E: Nonwoven fabric for molding
E1: Mass per unit area
E2: Thickness
E3: Stress at 20% elongation in the machine direction
E4: Stress at 20% elongation in the cross direction
E5: Evaluation for molding It was found from the results that when the stress at 20% elongation in the cross direction of a nonwoven fabric for molding was 24 to 36 N/3-cm-width, it showed a good moldability.

INDUSTRIAL APPLICABILITY

The nonwoven fabric for molding of the present invention can be suitably used in applications that require molding, because it has a good moldability capable of molding without the occurrence of wrinkles or the generation of fine unevenness on its surface. For example, it can be suitably used as surface materials for automobile, surface materials for partitions, or wall paper, in particular, surface materials for automobile, such as a headliner, a door side, a pillar garnish, a rear package, or the like.

Although the present invention has been described with reference to specific embodiments, various changes and modifications obvious to those skilled in the art are possible without departing from the scope of the appended claims.

REFERENCE SIGNS LIST

1 Nonwoven fabric for molding
2*a* Print of the first resin solution for printing
2*b* Print of the second resin solution for printing
MD Machine direction
CD Cross direction

The invention claimed is:

1. A nonwoven fabric for molding comprising a fiber web having a mass per unit area of 150 to 200 $g/m^2$, said fiber web comprising a binder-applied surface that comprises a binder for fiber bonding, wherein a stress at 20% elongation in the cross direction of the nonwoven fabric for molding is 24 to 36 N/3-cm-width, and wherein an amount of the binder for fiber bonding is 7 $g/m^2$ or less.

2. A surface material for automobile, consisting of the nonwoven fabric for molding according to claim 1.

3. A surface material for automobile, comprising the nonwoven fabric for molding according to claim 1.

4. A nonwoven fabric for molding according to claim 1, wherein an amount of the binder for fiber bonding is 6 $g/m^2$ or less.

5. A surface material for automobile according to claim 2, wherein, in the nonwoven fabric, an amount of the binder for fiber bonding is 6 $g/m^2$ or less.

6. A surface material for automobile according to claim 3, wherein, in the nonwoven fabric, an amount of the binder for fiber bonding is 6 $g/m^2$ or less.

* * * * *